US009483000B2

(12) United States Patent
Kasama

(10) Patent No.: US 9,483,000 B2
(45) Date of Patent: Nov. 1, 2016

(54) FIXING DEVICE AND IMAGE FORMING APPARATUS INCLUDING THE SAME

(71) Applicant: KYOCERA Document Solutions Inc., Osaka (JP)

(72) Inventor: Kenichi Kasama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/011,825

(22) Filed: Feb. 1, 2016

(65) Prior Publication Data

US 2016/0223965 A1 Aug. 4, 2016

(30) Foreign Application Priority Data

Jan. 30, 2015 (JP) ..... 2015-016868

(51) Int. Cl.
*G03G 15/20* (2006.01)

(52) U.S. Cl.
CPC ..... *G03G 15/2053* (2013.01)

(58) Field of Classification Search
None
See application file for complete search history.

(56) References Cited

U.S. PATENT DOCUMENTS 6,014,539 A * 1/2000 Sano ..... G03G 15/2053 219/216
9,046,834 B2 6/2015 Egi
2005/0180788 A1* 8/2005 Watanabe ..... G03G 15/2064 399/328
2009/0263168 A1* 10/2009 Baba ..... G03G 15/2053 399/329
2013/0195491 A1* 8/2013 Suzuki ..... G03G 15/2046 399/69
2014/0376979 A1* 12/2014 Egi ..... G03G 15/2053 399/329

FOREIGN PATENT DOCUMENTS

JP 2000132001 A * 5/2000

OTHER PUBLICATIONS

JP 2000132001 A English machine translation, Fuse et al., May 2000.*

* cited by examiner

*Primary Examiner* — David Gray
*Assistant Examiner* — Thomas Giampaolo, II
(74) *Attorney, Agent, or Firm* — Wenderoth, Lind & Ponack, L.L.P.

(57) ABSTRACT

In a fixing device including a cap member mounted at an end portion of a fixing belt in a rotation shaft direction via a rotation transfer member, an axis center of a support shaft supporting the cap member is made eccentric with respect to a rotation axis center of the fixing belt.

7 Claims, 6 Drawing Sheets

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2015-016868 filed on Jan. 30, 2015, the entire contents of which are incorporated herein by reference.

BACKGROUND

The technology of the present disclosure relates to a fixing device and an image forming apparatus including the same.

Conventionally, there has been known a fixing device including an endless fixing belt heated by a heating unit, a pressing pad abutting an inner peripheral surface of the fixing belt, and a pressure roller brought into press-contact with the pressing pad at a predetermined pressure while interposing the fixing belt between the pressing pad and the pressure roller. The pressure roller forms a fixing nip portion between the fixing belt and the pressure roller and applies rotational driving force to the fixing belt.

In this type of fixing device, when the fixing belt slips with respect to the pressure roller, there is a problem that the fixing belt is locally heated by the heating unit and thus is broken. In order to avoid such a problem, there has been proposed a fixing device in which a cap member is mounted at an end portion of the fixing belt in a rotation shaft direction and rotation of the cap member is detected by a rotation detection unit, so that rotation of the fixing belt is indirectly detected. In this fixing device, only when the rotation of the cap member (that is, the fixing belt) has been detected by the rotation detection unit, the heating unit is operated. The cap member has a cylindrical part that covers an outer peripheral surface of an end portion of the fixing belt and a disc part that covers one end side of the cylindrical part.

A rotation transfer member including an elastic member has been bonded to an inner peripheral surface of the cylindrical part. The rotation transfer member make contact with the outer peripheral surface of the fixing belt and transfers the rotation of the fixing belt to the cylindrical part of the cap member. The rotation transfer member is compressively deformed at a contact portion with the fixing belt, thereby ensuring a contact pressure.

SUMMARY

A fixing device according to one aspect of the present disclosure includes an endless fixing belt, a heating unit, an abutting member, a pressure roller, a cap member, a support shaft, a rotation transfer member, and a rotation detection unit. The heating unit heats the aforementioned fixing belt. The abutting member is arranged inside the aforementioned fixing belt and abuts an inner peripheral surface of the fixing belt. The pressure roller is brought into press-contact with the aforementioned abutting member at a predetermined pressure while interposing the aforementioned fixing belt between the abutting member and the pressure roller, thereby forming a fixing nip portion between the aforementioned fixing belt and the pressure roller and applying rotational driving force to the aforementioned fixing belt. The cap member has a cylindrical part arranged to cover an outer peripheral surface of an end portion of the aforementioned fixing belt in a rotation shaft direction and a disc part that covers one end side of the cylindrical part. The support shaft passes through the disc part of the aforementioned cap member and supports the cap member so as to be rotatable. The rotation transfer member includes an elastic member. The rotation transfer member is fixed to an inner peripheral surface of the cylindrical part of the aforementioned cap member. Furthermore, the rotation transfer member makes contact with at least a part of an outer peripheral surface of the aforementioned fixing belt, thereby transferring the rotation of the fixing belt to the aforementioned cap member. The rotation detection unit detects the rotation of the aforementioned cap member.

Furthermore, an axis center of the aforementioned support shaft is eccentric with respect to a rotation axis center of the aforementioned fixing belt.

DETAILED DESCRIPTION

Hereinafter, an example of an embodiment will be described in detail on the basis of the drawings. It is noted that the technology of the present disclosure is not limited to the following embodiments.

<<Embodiment>>

Figure 1:
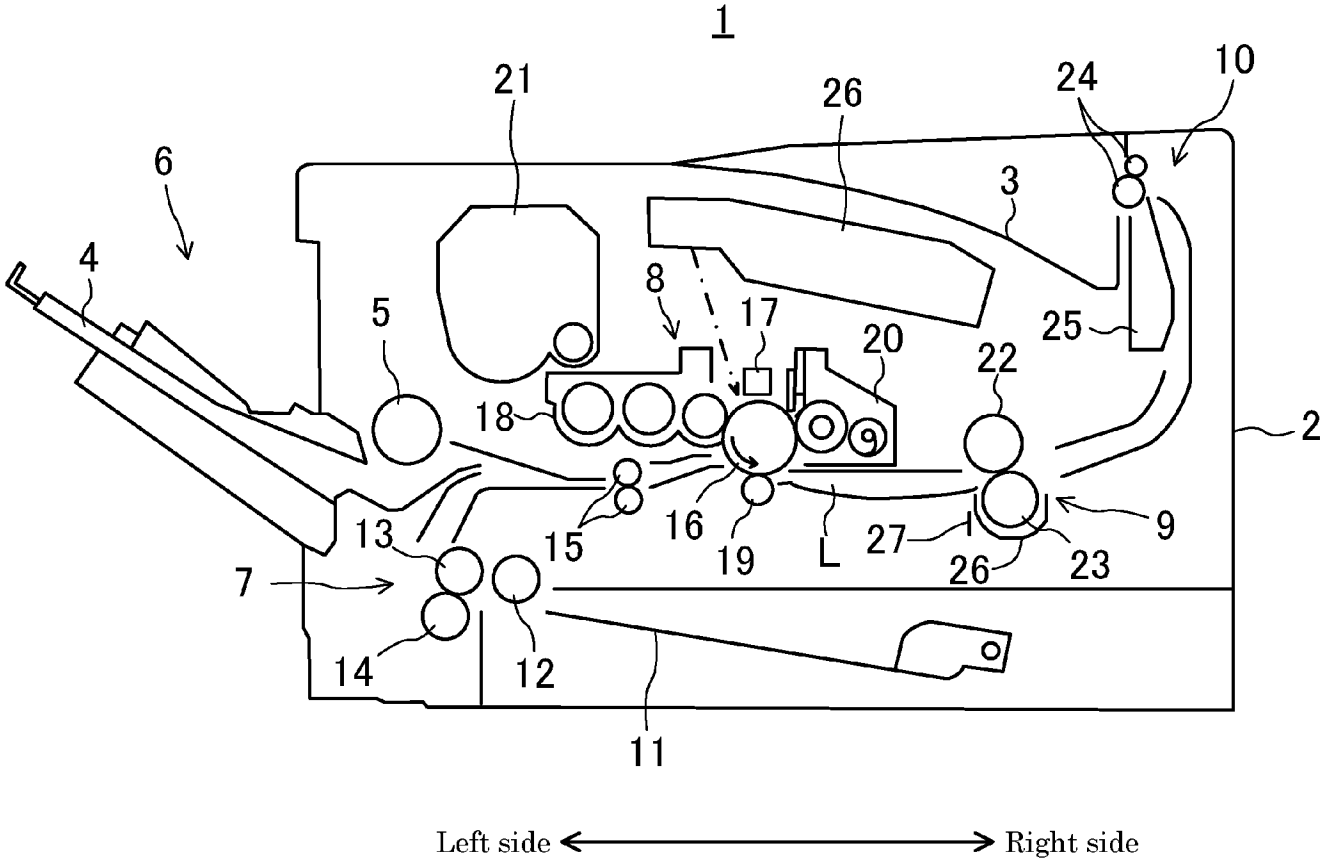
FIG. 1 is a schematic diagram illustrating an internal structure of an image forming apparatus including a fixing device in an embodiment.

FIG. 1 is a schematic diagram illustrating a laser printer, which is an example of an image forming apparatus 1 in the present embodiment. In the following description, a "front" and a "rear" indicate a front side and a rear side of the image forming apparatus 1, and a "left" and a "right" indicate a left side and a right side when the image forming apparatus 1 is viewed from the front side.

As illustrated in FIG. 1, the image forming apparatus 1 includes a box-like printer body 2, a manual paper feeding unit 6, a cassette paper feeding unit 7, an image forming unit 8, a fixing device 9, and a paper discharge unit 10. In this way, the image forming apparatus 1 is configured to form an image on a paper on the basis of image data transmitted from a terminal and the like (not illustrated) while conveying the paper along a conveyance path T in the printer body 2.

The manual paper feeding unit 6 has a manual tray 4 provided at one side portion of the printer body 2 so as to be openable and closable, and a manual paper feeding roller 5 provided in the printer body 2 so as to be rotatable.

The cassette paper feeding unit 7 is provided at a bottom portion of the printer body 2. The cassette paper feeding unit 7 includes a paper feeding cassette 11 that stores a plurality of papers overlapped one another, a pick roller 12 that takes out the papers in the paper feeding cassette 11 one by one, and a feed roller 13 and a retard roller 14 that separate the taken-out papers one by one and send the separated paper to the conveyance path T.

The image forming unit 8 is provided above the cassette paper feeding unit 7 in the printer body 2. The image forming unit 8 includes a photosensitive drum 16 serving as an image carrying member provided in the printer body 2 so as to be rotatable, a charging device 17 arranged around the photosensitive drum 16, a developing unit 18, a transfer roller 19, a cleaning section 20, a laser scanner unit (LSU) 26 arranged above the photosensitive drum 16 and serving as an optical scanning device, and a toner hopper 21. In this way, the image forming unit 8 is configured to form an image on the paper supplied from the manual paper feeding unit 6 or the cassette paper feeding unit 7.

At the conveyance path T, a pair of resist rollers 15 are provided to temporarily keep the taken-out paper waiting and then supply the paper to the image forming unit 8 at a predetermined timing.

The fixing device 9 is arranged at a lateral side of the image forming unit 8. The fixing device 9 includes a fixing belt 22 and a pressure roller 23 brought into press-contact with the fixing belt 22 by an urging member (not illustrated). In this way, the fixing device 9 is configured to fix a toner image, which has been transferred to a paper in the image forming unit 8, to the paper.

The paper discharge unit 10 is provided above the fixing device 9. The paper discharge unit 10 includes a paper discharge tray 3, a paper discharge roller pair 24 for conveying papers to the paper discharge tray 3, and a plurality of conveying guide ribs 25 that guide papers to the paper discharge roller pair 24. The paper discharge tray 3 is formed in a concave shape at an upper portion of the printer body 2.

When the image forming apparatus 1 receives image data, the photosensitive drum 16 is rotationally driven and the charging device 17 charges the surface of the photosensitive drum 16 in the image forming unit 8.

Furthermore, on the basis of the image data, laser light is emitted to the photosensitive drum 16 from the laser scanner unit 26. The laser light is irradiated, so that an electrostatic latent image is formed on the surface of the photosensitive drum 16. The electrostatic latent image formed on the photosensitive drum 16 is developed by toner charged in the developing unit 18 and becomes a visible image as a toner image.

Thereafter, the paper passes through between the transfer roller 19 and the photosensitive drum 16, and a bias having a charged polarity opposite to that of toner is applied to the paper when the paper passes through. As a consequence, the toner image of the photosensitive drum 16 is transferred to the paper. The paper with the transferred toner image is heated and pressed by the fixing belt 22 and the pressure roller 23 in the fixing device 9. As a consequence, the toner image is fixed to the paper.

Figure 2:
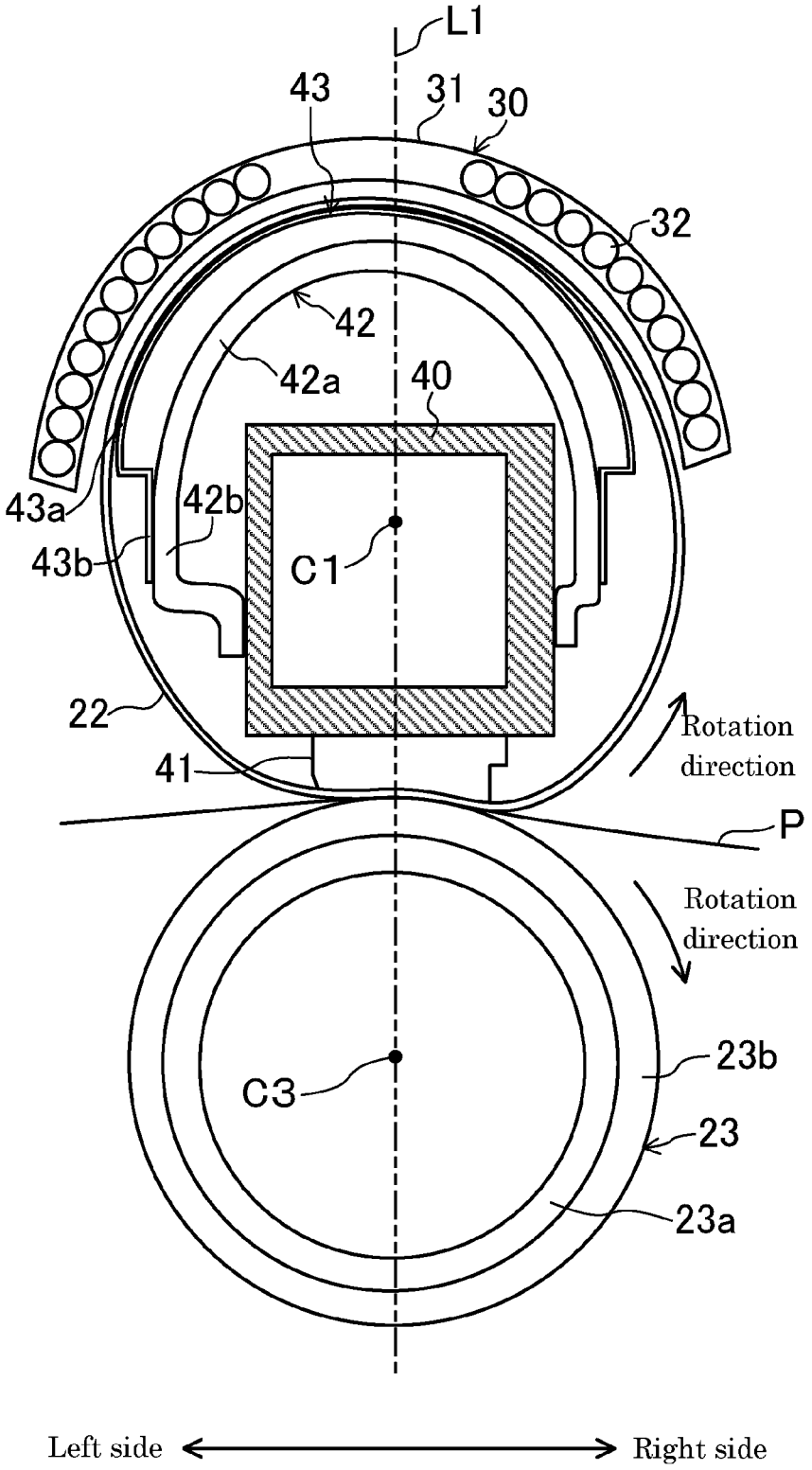
FIG. 2 is a sectional view illustrating a fixing device, which has been cut along a section vertical to a rotation shaft direction of a fixing belt.

As illustrated in FIG. 2, the fixing device 9 includes the aforementioned fixing belt 22, the aforementioned pressure roller 23, an induction heating unit 30, a stay 40, a pressing pad 41, a magnetic shielding member 42, and a guide member 43.

The fixing belt 22 is an endless heat resistant belt and is configured by sequentially stacking, from an inner peripheral side, an induction heating layer made of an electroformed nickel, an elastic layer made of a silicon rubber and the like, and a release layer made of a fluororesin and the like, and improving release properties when an unfixed toner image is melt and fixed at a nip portion N. In FIG. 2, these layers are not distinguished from one another and have been drawn in a simplified manner.

The pressure roller 23 is supported to a housing of the fixing device 9 so as to be rotatable. The pressure roller 23 includes a cored bar 23*a* made of a stainless steel and the like, an elastic layer 23*b* provided on an outer peripheral surface of the cored bar 23*a* and made of a silicon rubber and the like, and a release layer (not illustrated) made of a fluororesin and the like and covering the surface of the elastic layer 23*b*. Furthermore, the pressure roller 23 is rotationally driven by a driving source such as a motor (not illustrated), and the fixing belt 22 is rotated by the rotation of the pressure roller 23. At a part at which the pressure roller 23 and the fixing belt 22 are brought into press-contact with each other, the nip portion N is formed, and in the nip portion N, an unfixed toner image on a conveyed paper is heated and pressed and thus is fixed to the paper.

The induction heating unit 30 is arranged so as to cover an upper end portion of the fixing belt 22. The induction heating unit 30 heats the fixing belt 22 by electromagnetic induction. The induction heating unit 30 has a case member 31 and a coil 32 stored in the case member 31. A heating value (that is, a current) of the coil 32 is controlled by a controller 100 (see FIG. 3) which will be described later.

The stay 40 is formed of a metallic cylindrical body having a sectional rectangular shape. The stay 40 extends in the fixing belt 22 in a front and rear direction (a rotation shaft direction of the fixing belt 22).

The pressing pad 41 is fixed to a lower surface of the stay 40. The pressing pad 41, for example, is made of liquid crystal polymer and presses the fixing belt 22 to the pressure roller 23 side. The pressure roller 23 is urged to the pressing pad 41 side by an urging member (not illustrated). The pressure roller 23 is pressed to the pressing pad 41 while interposing the fixing belt 22 between the pressing pad 41 and the pressure roller 23.

The magnetic shielding member 42 has a curved plate part 42*a* protruding upward and having a sectional arc shape and bending plate parts 42*b* connected to both right and left ends of the curved plate part 42*a*. The curved plate part 42*a* is fixed to the side of the stay 40 via the bending plate parts 42*b*. The magnetic shielding member 42 is configured by a non-magnetic material having a good conductivity. The magnetic shielding member 42 prevents a magnetic field generated by the induction heating unit 30 from passing through the stay 40.

The guide member 43 is provided so as to cover an upper side of the magnetic shielding member 42. The guide member 43 has a guide body 43*a* protruding upward and having a sectional arc shape and mounting parts 43*b* connected to both right and left ends of the guide body 43*a*. Each mounting part 43*b* is mounted at the bending plate part 42*b* of the magnetic shielding member 42.

The guide body 43*a* is arranged at an opposite side of the pressing pad 41 while interposing a rotation axis center C1 of the fixing belt 22 between the pressing pad 41 and the guide body 43*a*. The guide body 43*a* is arranged across a straight line L (see FIG. 5) passing through an axis center C3 of the pressure roller 23 and the rotation axis center C1 of the fixing belt 22 when viewed from the rotation shaft direction of the fixing belt 22. The guide body 43*a* is arranged facing the induction heating unit 30 and guides the inner peripheral surface of the fixing belt 22 such that the fixing belt 22 travels along the induction heating unit 30. An outer peripheral surface of the guide body 43*a* serves as a guide surface by abutting the inner peripheral surface of the fixing belt 22.

Figure 3:
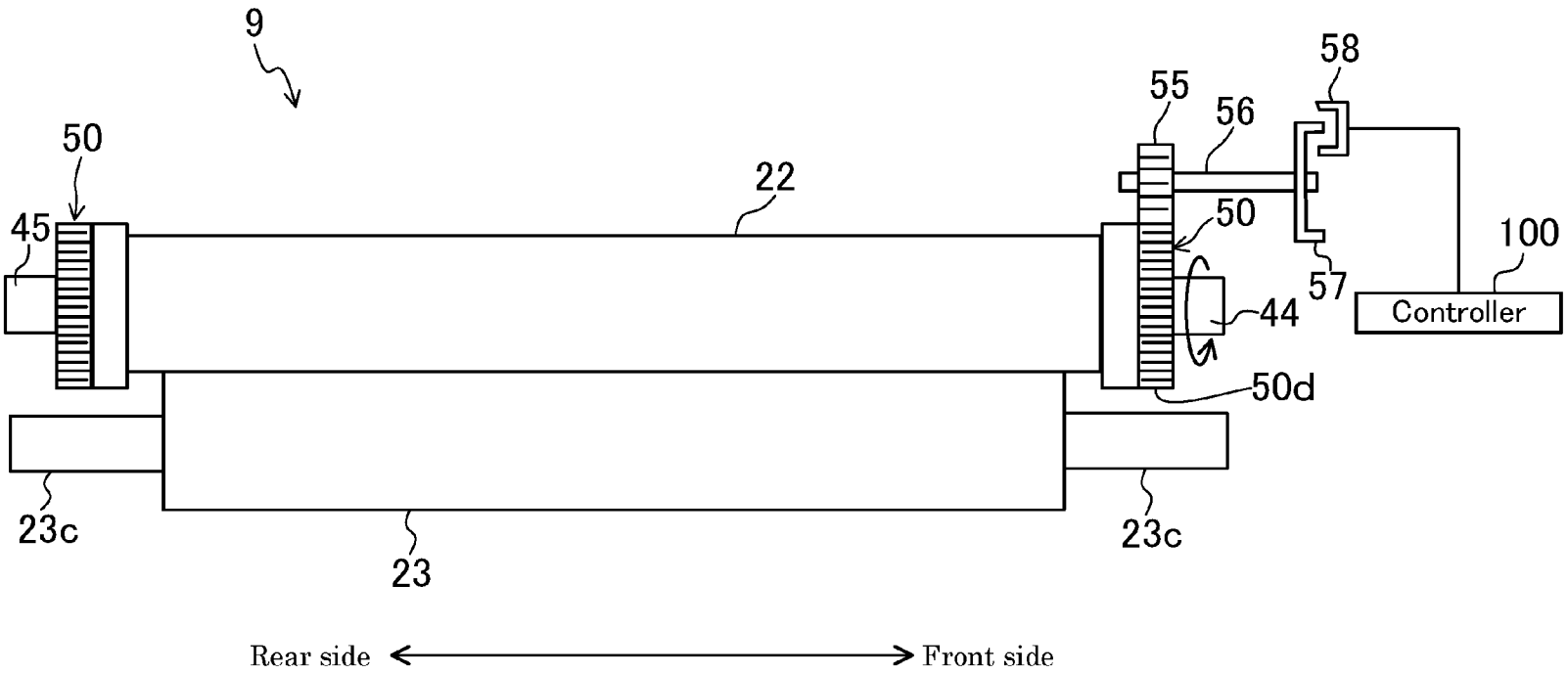
FIG. 3 is a side view illustrating a fixing device, which is viewed from a direction perpendicular to a rotation shaft direction of a fixing belt.
Figure 4:
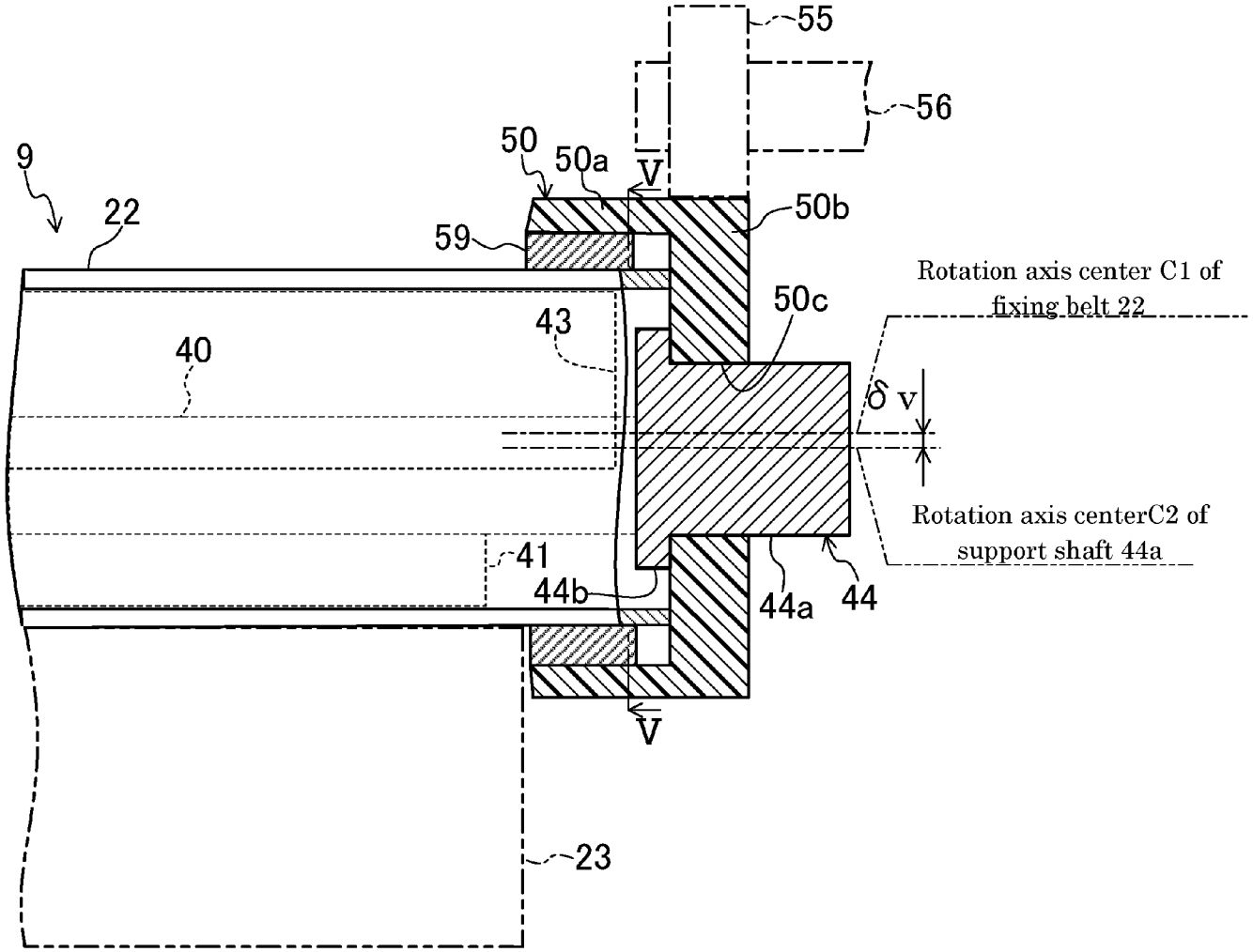
FIG. 4 is a partial sectional view of a front end portion of a fixing device.

As illustrated in FIG. 3 and FIG. 4, the fixing device 9 further includes a pair of cap members 50 mounted at both ends of the fixing belt 22 in the front and rear direction (the rotation shaft direction), a cap support member 44 that supports each cap member 50 so as to be rotatable, a member 57 to be detected, which is rotated according to one cap member 50, and a rotation detection sensor (a rotation detection unit) 58 that detects the rotation of the member 57 to be detected.

The cap member 50 has a cylindrical part 50*a* that covers an end portion of the fixing belt 22 in the rotation shaft direction from a radial direction outside, and a disc part 50*b* that covers one end side of the cylindrical part 50*a* in an axial direction. The other end side of the cap member 50 in the axial direction is opened. The cap member 50 is fitted onto an end portion of the fixing belt 22 in the axial direction from the opening side. The disc part 50*b* is formed at a center portion thereof with a through hole 50*c*. A support shaft 44*a* of the cap support member 44 passes through the through hole 50*c*.

At an outer peripheral surface of the cylindrical part 50*a* of the cap member 50, a gear portion 50*d* (see FIG. 3) is formed to be engaged with a driven gear 55. The driven gear 55 is connected to the member 57 to be detected via a connection shaft 56. The member 57 to be detected is formed in a cylindrical cap shape. The rotation detection sensor 58 includes a PI sensor having a light emitting part and a light receiving part. The rotation detection sensor 58 is arranged such that a peripheral wall of the member 57 to be detected is positioned between the light receiving part and the light emitting part. The peripheral wall of the member 57 to be detected is formed with a slit hole for rotation detection. The rotation detection sensor 58 detects whether the member 57 to be detected rotates at a predetermined speed and outputs a detection signal to the controller 100.

The controller 100 includes a microcomputer having a CPU, a ROM, a RAM and the like. On the basis of the detection signal from the rotation detection sensor 58, the controller 100 determines whether the cap member 50 rotates at a predetermined speed. When it has been determined that the cap member 50 rotates at the predetermined speed (that is, when it has been determined that the fixing belt 22 does not slip and normally rotates), the controller 100 operates the induction heating unit 30, and when it has been determined that the cylindrical part 50*a* does not rotate at the predetermined speed (that is, when it has been determined that the fixing belt 22 slips), the controller 100 stops the operation of the induction heating unit 30.

The cap support member 44 has been fixed to both end portions of the stay 40 in the front and rear direction. The aforementioned stay 40 has been fixed to the housing of the fixing device 9 via the cap support member 44. The cap support member 44 has the support shaft 44*a* having a columnar shape and a flange part 44*b* protruding in a flange shape to a radial direction outside from the end portion of the support shaft 44*a* at the stay 40 side. The support shaft 44*a* is fitted into the through hole 50*c* formed in the cap member 50 and supports the cap member 50 so as to be rotatable. An axis center C2 of the support shaft 44*a* and an axis center of the through hole 50*c* coincide with each other.

Figure 5:
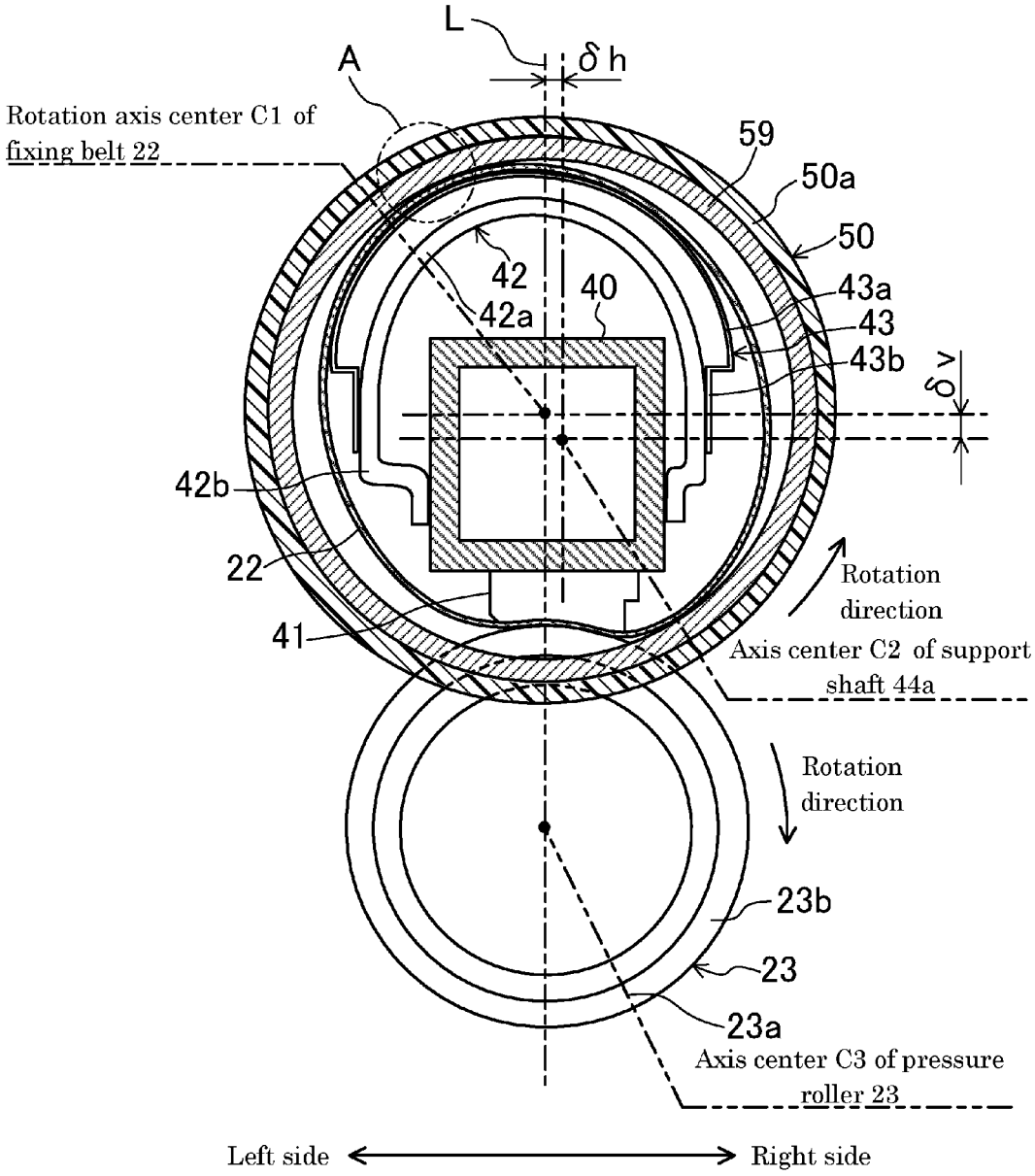
FIG. 5 is a sectional view taken along line V-V of FIG. 4.

As illustrated in FIG. 4 and FIG. 5, a rotation transfer member 59 is mounted at the inner peripheral surface of the cylindrical part 50*a* of the cap member 50 to transfer the rotation of the fixing belt 22 to the cap member 50. The rotation transfer member 59 is formed in a cylindrical shape and is configured by an elastic member such as a rubber. An outer peripheral surface of the rotation transfer member 59 has been bonded to the inner peripheral surface of the cylindrical part 50*a* by a bonding material.

In the state in which the aforementioned cap member 50 has been mounted at the fixing belt 22, at least a part of an inner peripheral surface of the rotation transfer member 59 in a circumferential direction makes contact with the outer peripheral surface of the fixing belt 22. The rotation transfer member 59 is compressively deformed at the contact portion. During the rotation of the fixing belt 22, frictional force (that is, grip force) is generated by contract pressure between the rotation transfer member 59 and the fixing belt 22. In this way, the rotation transfer member 59 rotates together with the fixing belt 22 and the rotation of the fixing belt 22 is transferred to the cap member 50 via the rotation transfer member 59.

As illustrated in FIG. 5, an axis center of the cap member 50, that is, the axis center C2 of the support shaft 44*a* (illustrated only in FIG. 4) of the cap support member 44 is eccentric with respect to the rotation axis center C1 of the fixing belt 22. The position of the rotation axis center C1 of the fixing belt 22, for example, can be obtained by three-dimensional measurement. In the three-dimensional measurement, firstly, the cap support member 44 is detached while the position of the stay 40 is being held. In this state, the pressure roller 23 is driven to rotate the fixing belt 22, and the rotation center of the fixing belt 22 being rotated is measured by a three-dimensional measuring instrument.

The axis center C2 of the support shaft 44*a* is eccentric downward (to an opposite side of a side, at which the guide member 43 is positioned with respect to the rotation axis center C1 of the fixing belt 22) from the rotation axis center C1 of the fixing belt 22 by a distance $\delta v$. The axis center C2 of the support shaft 44*a* is further eccentric rightward from the aforementioned straight line L by a distance $\delta h$.

In the fixing device 9 configured as above, when the fixing belt 22 rotates by receiving driving force from the pressure roller 23, the rotation of the fixing belt 22 is transferred to the cylindrical part 50*a* of the cap member 50 via the rotation transfer member 59. In this way, the cap member 50 rotates in synchronization with the fixing belt 22. The rotation of the cap member 50 is transferred to the member 57 to be detected via the driven gear 55 and the connection shaft 56, and the rotation of the member 57 to be detected is detected by the rotation detection sensor 58. Consequently, it is possible to indirectly detect the rotation of the fixing belt 22 by the rotation detection sensor 58.

In the aforementioned embodiment, the axis center C2 of the support shaft 44*a* (illustrated only in FIG. 4) supporting the cap member 50 is eccentric with respect to the rotation axis center C1 of the fixing belt 22. Consequently, at a part (a part surrounded by a two dot chain line of FIG. 5) of the rotation transfer member 59, which is positioned at an opposite side of the eccentric side of the support shaft 44*a*, it is possible to enhance contact pressure between the rotation transfer member 59 and the fixing belt 22 as much as possible. Thus, it is possible to sufficiently enhance frictional force generated at a contact part between and the rotation transfer member 59. Thus, it is possible to reliably transfer the rotation of the fixing belt 22 to the cap member 50 by the rotation transfer member 59 without being affected by an error of a shape dimension of the rotation transfer member 59 and the reduction of elastic force due to a secular change. Accordingly, it is possible to accurately perform the rotation detection of the fixing belt 22 using the cap member 50.

Herein, the aforementioned fixing belt 22 rotates on the outer peripheral surface of the guide body 43*a* toward a left end from a right end of the guide body 43*a* (from one end to the other end of a circumferential direction) (see FIG. 5). Consequently, the fixing belt 22 is made to easily fit with the outer peripheral surface of the guide body 43*a* at the left end side of the guide body 43*a* and is easily loosened at the right end side thereof. In the aforementioned embodiment, focusing on this point, the axis center C2 of the support shaft 44*a* supporting the cap member 50 is made eccentric rightward from the aforementioned straight line L, that is, to the loosened side of the fixing belt 22, by δh. According to this, the rotation transfer member 59 fixed to the inner peripheral surface of the cap member 50 can be actively pressed to the fitting side and not to the loosened side of the fixing belt 22. Consequently, it is possible to further enhance the contact pressure between the rotation transfer member 59 and the fixing belt 22. Consequently, it is possible to further improve rotation transfer efficiency by the rotation transfer member 59.

As with the aforementioned embodiment, when the axis center C2 of the support shaft 44*a* of the cap support member 44 is made eccentric with respect to the rotation axis center C1 of the fixing belt 22, frictional resistance between the outer peripheral surface of the support shaft 44*a* and the through hole 50*c* (see FIG. 4) of the cap member 50 may increase. In order to prevent such a problem, it is preferable that the surface roughness of the inner peripheral surface of the through hole 50*c*, or the surface roughness of an outer peripheral surface of a part of the support shaft 44*a* passing through the through hole 50*c*, for example, is made equal to or more than Ra (arithmetic average roughness) of 50 μm.

Figure 6:
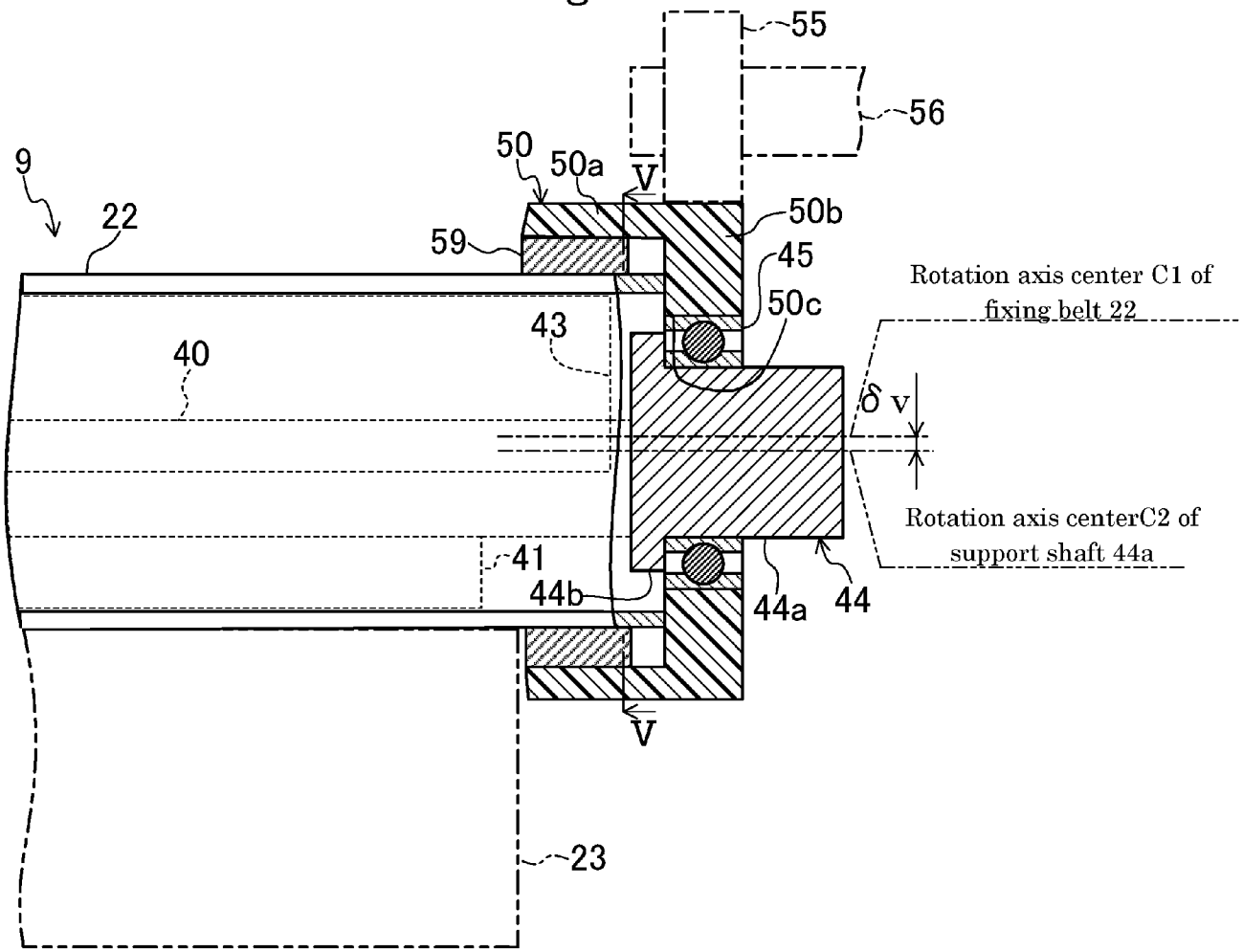
FIG. 6 is a partial view of a front end portion of a fixing device including a bearing.

In this way, a contact area between the outer peripheral surface of the support shaft 44*a*and the inner peripheral surface of the through hole 50*c* of the cap member 50 is made small as much as possible, so that it is possible to reduce frictional resistance generated between the two. Accordingly, it is possible to prevent the cap member 50 from slipping with respect to the fixing belt 22. According to other configurations, a bearing 45, as illustrated in FIG. 6, may also be interposed between the outer peripheral surface of the support shaft 44*a* and the inner peripheral surface of the through hole 50*c* of the cap member 50. In this way, it is possible to further reduce the frictional resistance between the support shaft 44*a* and the cap member 50.

<<Other Embodiments>>

In the aforementioned embodiment, the image forming apparatus 1 is configured by a laser printer; however, the present invention is not limited thereto and the image forming apparatus 1, for example, may also include a copy machine, a multifunctional peripheral and the like.

In the aforementioned embodiment, the fixing belt 22 is heated by the induction heating unit 30; however, the present invention is not limited thereto and the fixing belt 22 may also be heated by a halogen heater and the like.

What is claimed is:

1. A fixing device comprising:

an endless fixing belt;

a heating unit that heats the fixing belt;

an abutting member arranged inside the fixing belt and abutting an inner peripheral surface of the fixing belt;

a pressure roller brought into press-contact with the abutting member at a predetermined pressure while interposing the fixing belt between the abutting member and the pressure roller, thereby forming a fixing nip portion between the fixing belt and the pressure roller and applying rotational driving force to the fixing belt;

a cap member having a cylindrical part arranged to cover an outer peripheral surface of an end portion of the fixing belt in an axial direction of the fixing belt and a disc part that covers one end side of the cylindrical part;

a support shaft that is coaxially arranged with the cap member and engaged with a through hole formed in a center part of the disc part of the cap member and supports the cap member so as to be rotatable;

a rotation transfer member including a cylindrical elastic member only provided between a cylindrical inner peripheral surface of the cap member and the outer peripheral surface of the fixing belt, and fixed to the inner peripheral surface of the cylindrical part to make contact with at least a part of the outer peripheral surface of the fixing belt, thereby transferring rotation of the fixing belt to the inner peripheral surface of the cap member by friction force from the part in contact;

a rotation detection unit for detecting rotation of the cap member; and a guide member forming an arc shape across a straight line passing through a rotation axis center of the fixing belt and an axis center of the pressure roller when viewed from the axial direction of the fixing belt, and having an outer peripheral surface abutting the inner peripheral surface of the fixing belt to guide the rotation of the fixing belt, wherein the fixing belt rotates on the outer peripheral surface of the guide member from one end to another end of the outer peripheral surface in a circumferential direction by a rotational driving force applied by the pressure roller, and wherein an axis center of the support shaft is eccentric to one end side of the straight line with respect to the rotation axis center of the fixing belt.

2. The fixing device of claim 1, wherein the through hole allows the support shaft to pass therethrough and is engaged with the support shaft, and a surface roughness Ra of an inner peripheral surface of the through hole or an outer peripheral surface of a part of the support shaft passing through the through hole is equal to or more than 50 μm.

3. The fixing device of claim 2, wherein the axis center of the support shaft is eccentric to a pressure roller side with respect to the rotation axis center of the fixing belt.

4. The fixing device of claim 1, further comprising a bearing provided between an inner peripheral surface of the through hole and an outer peripheral surface of the support shaft, wherein the support shaft is engaged with the through hole via the bearing.

5. The fixing device of claim 4, wherein the axis center of the support shaft is eccentric to a pressure roller side with respect to the rotation axis center of the fixing belt.

6. An image forming apparatus comprising the fixing device of claim 1.

7. The fixing device of claim 1, wherein the axis center of the support shaft is eccentric to a pressure roller side with respect to the rotation axis center of the fixing belt.

* * * * *